United States Patent [19]

Litz

[11] Patent Number: 4,544,207

[45] Date of Patent: Oct. 1, 1985

[54] PROCESS FOR THE UNIFORM DISTRIBUTION OF A TWO PHASE MIXTURE

[75] Inventor: Lawrence M. Litz, Pleasantville, N.Y.

[73] Assignee: Union Carbide Corporation, Danbury, Conn.

[21] Appl. No.: 397,974

[22] Filed: Jul. 14, 1982

[51] Int. Cl.[4] ..... E21B 43/28

[52] U.S. Cl. ..... 299/5; 137/3; 137/8; 366/336; 366/340

[58] Field of Search ..... 299/5; 137/3, 12.5, 137/8, 170.5, 170.4, 170.1; 366/340, 336

[56] References Cited

U.S. PATENT DOCUMENTS

| | | | |
|---|---|---|---|
| 3,734,111 | 5/1973 | McClintock | 137/3 |
| 3,849,086 | 11/1974 | Johnson | 366/340 |
| 4,222,611 | 9/1980 | Larson et al. | 299/5 |
| 4,339,152 | 7/1982 | Warner et al. | 299/5 |
| 4,344,651 | 8/1982 | Longacre | 299/5 |
| 4,351,566 | 9/1982 | Yan et al. | 299/5 |
| 4,360,234 | 11/1982 | Hsueh | 299/5 |

*Primary Examiner*—James A. Leppink
*Assistant Examiner*—Hoang C. Dang
*Attorney, Agent, or Firm*—Saul R. Bresch

[57] ABSTRACT

In a process for the uniform distribution of a two phase gas/liquid or liquid/liquid mixture comprising delivering a first stream of said mixture to a point, and dividing the first stream at the point into at least two streams, the improvement comprising creating a turbulent environment in the first stream just prior to the point at which the first stream is divided into at least two streams.

5 Claims, 1 Drawing Figure

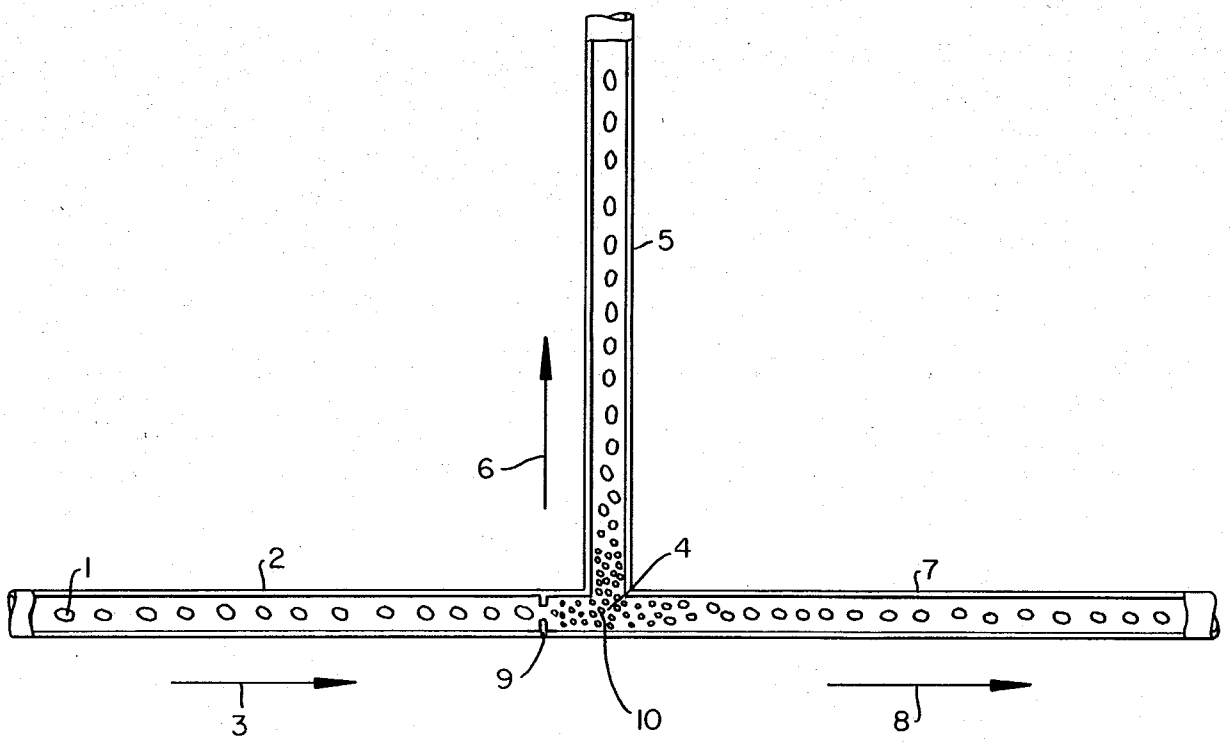
1
2
3
4
5
6
7
8
9
10

PROCESS FOR THE UNIFORM DISTRIBUTION OF A TWO PHASE MIXTURE

TECHNICAL FIELD

This invention relates to a process for the uniform distribution of a two phase gas/liquid or liquid/liquid mixture throughout a branched conduit system.

BACKGROUND ART

A two phase gas/liquid or liquid/liquid mixture is one in which the gas and liquid or the liquid components retain their original physical characteristics even though mixed together. Bubbles of an undissolved gas distributed in a liquid or insoluble globules or droplets of a liquid dispersed in a liquid generally exemplify the two phase mixtures contemplated here.

In certain industrial operations, it is desirable to supply an essentially uniform mixture at components to more than one location, i.e., to maintain the initial ratio of gas to liquid or liquid to liquid from the beginning of the operation through to the use point. The in-situ leaching of uranium, copper, nickel, or other minerals from their ores is one such operation.

In-situ leaching is a well known technique for recovering metal values under ground. This process involves injecting a lixiviant or leach solution into one or more wells where the lixiviant is forced into adjoining ore zones containing the desired mineral. A typical in-situ leaching operation may involve twenty to several hundred wells. The mineral dissolves in the lixiviant and the mineral bearing or pregnant lixiviant is then pumped to the surface via the same or other wells drilled in the strata into which the barren lixiviant is injected. This dissolved mineral is stripped from the pregnant lixiviant by ion exchange or other conventional techniques and the barren lixiviant, after appropriate adjustment of its composition, is reinjected into the ore zone.

For certain minerals such as uranium it is necessary to oxidize the ores underground with oxygen or some other oxidant in order to convert the mineral to a state in which it is soluble in the lixiviant. Various means for providing oxygen in either the dissolved or undissolved form are known in in-situ mining. Most in-situ uranium mining operations use some form of down-hole sparging for injection of the oxygen gas into the lixiviant. The oxygen is typically distributed at about 100 to about 300 pounds per square inch gauge (psig) from one or more central liquid storage and evaporation units through a piping system to each of the multitude of injection wells in a given leach field. The oxygen is fed through a flow control valve and flow-metering device located at each injection well-head down through a tube within the well to a sparger or other gas distribution unit at or near the bottom of the well. Lixiviant is fed in from the well-head and flows down the well bore counter-current to the gas bubbles rising up the well. Under the combined pressure of the hydrostatic and dynamic heads, oxygen gas becomes dissolved in the lixiviant in the course of this counter-current flow. The dissolved oxygen is then carried by the lixiviant into the ore zone where the desired oxidation takes place. The common practice for this type of operation is to have parallel arrays for the lixiviant and the oxygen gas such that the lixiviant and the oxygen are fed proportionately through meters and flow control equipment to provide the desired lixiviant/oxygen ratio.

While the use of meters and flow control equipment adds to the cost of the in-situ leaching operation, merely distributing the oxygen and lixiviant throughout a network of injection wells without controls results in an unsatisfactory distribution of both with some wells receiving too little oxygen and others more than can be efficiently utilized.

One technique for avoiding a complex gas/lixiviant distribution system with its multiplicity of meters and control valves and still maintain control is to dissolve the oxygen in the lixiviant at the surface thus providing a single phase fluid which can be distributed throughout the network of pipes and wells without concern for changes in the ratio of gas to lixiviant. This approach, however, is only applicable when the quantity of gas needed for the in-situ leaching of the mineral is such that the gas can be completely dissolved in the lixiviant and maintained in solution, economically, at the pressure and temperature prevailing throughout the system, i.e., at the surface dissolver and in the lixiviant distribution network. In many cases, the required concentrations of gas are such that uneconomically high pressures would be needed to maintain the gas in solution from the dissolver to the point of injection into the ore zone.

DISCLOSURE OF THE INVENTION

An object of this invention is to provide an improvement in a process for delivering a two phase gas/liquid or liquid/liquid mixture through a network of conduits to a use point whereby the mixture maintains a uniform composition throughout while being delivered in an economic fashion, i.e., using a minimum amount of equipment and pressure to accomplish the task.

Other objects and advantages will become apparent hereinafter.

According to the present invention such as improvement in a process for the uniform distribution of a two phase gas/liquid or liquid/liquid mixture comprising delivering a first stream of said mixture to a point, and dividing the first stream at the point into at least two streams, has been discovered. The improvement comprises creating a turbulent environment in the first stream just prior to the point at which the first stream is divided.

BRIEF DESCRIPTION OF DRAWING

The sole FIGURE is a schematic diagram of a plan view of one junction in a network of conduits.

DETAILED DESCRIPTION

The two phase delivery process described here is a co-current process in which gas in excess of saturation is injected into liquid at a central location and the mixture then proceeds through the distribution network. The network of conduits or pipes can also be referred to as a branched conduit or piping system. The network may simply be one main pipe with many branches or it can be a series of pipes, each of which meets at a junction with two or more pipes. The net effect is that at each junction one stream is divided into two or more streams. Typically, each division is into two or three streams.

The "turbulent environment" is a condition created in the two-phase flow wherein the mixing forces of the turbulent eddies overcome the tendency of one phase, i.e., the smaller gas bubbles or liquid droplets, to coalesce and form large bubbles, which float on the top or reside at the bottom of the continuous phase. This results in a well dispersed bubble flow pattern, the small bubbles (or discontinuous phase) being uniformly distributed across the flow cross-section. Turbulent eddies are currents moving against the main flow current with a circular motion. As the main flow reaches a certain critical velocity, these turbulent eddies spread rapidly throughout the fluid producing a disruption of the entire flow pattern. Shear forces created by the eddies lead to size reduction and dispersion of the bubble or droplet phase in the surrounding liquid phase.

Referring to the drawing:

Gas bubbles 1 surrounded by a liquid pass through pipe 2 in the direction of arrow 3 towards junction 4. The liquid is considered to be the continuous phase and the gas bubbles, the discontinuous phase. The dispersion of large bubbles in the liquid as shown is characteristic of a vertical pipe. Where the pipe is horizontal, the large bubbles, which may be 20 millimeters or more in length, flow along the upper part of the pipe (provided its density is lower than that of the liquid) and the liquid flows along the lower part of the pipe. Turbulence promoter 9 (in this case, a plate containing a circular orifice) is located in pipe 2 a short distance before junction 4. A turbulent environment is created between turbulence promoter 9 and junction 4 whereby the gas bubbles are extensively subdivided into small bubbles 10. The small bubbles are no larger than about 5 millimeters in the greatest dimension and are preferably no larger than about 2 millimeters in the greatest dimension. The stream separates at junction 4 into two streams, one passing through pipe 5 in the direction of arrow 6 and the other through pipe 7 in the direction of arrow 8. Small bubbles 10 proceed a short distance into pipes 5 and 7 and then coalesce to form bubbles similar in size to initial gas bubbles 1, and the initial ratio of gas to liquid is maintained.

Instead of orifice-containing turbulence promoter 9, other devices can be used to create the turbulent environment, e.g., static mixers, pipe restrictions or constrictions, plates containing orifices of various shapes and sizes in addition to circular, baffles, pipe expansions, pipes sized to give liquid velocities in excess of about ten feet per second, and pipe elbows. It is noted that turbulance is created by an abrupt change in the velocity of the continuous phase; either an abrupt increase or decrease in velocity will cause this effect. The aforementioned devices are capable of accomplishing the abrupt change.

The device that creates the turbulent environment, i.e., the turbulence promoter, is located just close enough to the point at which the stream divides so that small bubbles are formed, but do not have a chance to coalesce before they enter the branches. As a rule of thumb, the turbulence promoter is located at a distance from junction 4 equal to at least about the diameter of pipe 2. Junction 4 is considered to be the central point of the common area shared by the first stream and the streams into which the first stream divides. The area of maximum turbulence is considered to be the area where the small bubbles are uniformly distributed throughout the liquid. This is generally achieved in the common area and may extend into the branches for a distance from junction 4 about equal to two or three or more times the diameter of any of the connecting pipes. The center or maximum turbulence will vary, however, with the flow velocity, the type of turbulence promoter used, and the distance of the promoter from the junction.

The turbulence promoter becomes increasingly ineffectual as it is removed from junction 4 except in cases where the continuous phase is moving at an extremely high velocity.

In an in-situ leaching system, subject improvement permits the oxygen gas to be injected at only one point or at most a few points in the main barren lixiviant feed line instead of feeding the oxygen into each injection well. Gas metering and control devices, as well as the operating labor required to maintain the gas flow, at each well are unnecessary. Further, the required amount of oxygen may be dissolved in the lixiviant during its passage down the individual wells to the ore zone under the pressure existing within the well. To insure that the gas phase being fed into each well from the two phase distribution network is carried down the well with the liquid, it is necessary that the flow velocity down the downcomer pipe, which carries the liquid from the well-head at the surface down into the well, be greater than one foot per second. This requirement is fulfilled by using a downcomer pipe sized to provide this velocity at the lowest flow at which the given individual well is expected to be operated. While lixiviant flowmeters are typically used at each well to provide fluid injection accountability, the flowmeters are not required as a means for balancing the oxygen-lixiviant ratio.

The following examples illustrate the invention.

EXAMPLE 1

A horizontal piping system is built of transparent plastic pipe with a series of connected pipe arrangements, each as shown in the drawing. The pipes are sized for liquid flow rates in the range of 0 to 69 gallons of liquid per minute and for air flow rates in the range of 0 to 54 cubic feet per hour. The main line and each pipe arrangement are constructed of 1.5 inch, schedule 40, pipe. A plate with an orifice is placed in two of three pipe arrangements (at 9 in the drawing). Placement of the plate is 6 inches from the center point of junction 4. Flowmeters are used to measure flows in each branch (5 and 7 in the drawing). Adjustments in flows can be made with valves downstream of the flowmeters and such adjustments are made to assure that an equal water volume flows through each branch under all conditions. Sample lines are installed in each branch to permit removal of the gas/liquid mixture flowing down the branch with the valve downstream of the flowmeter closed and the sample valve adjusted to provide the same pressure drop as the system in the normal flow mode so that the flow is the same during the sample period as during the measurement period. Measurements are made of the gas to liquid ratio in pipes 5 and 7 to determine the uniformity or non-uniformity of the gas distribution. The measurements are made as follows: The gas/liquid mixture being sampled is fed continuously into a tank initially filled with water wherein the gas phase separates from the liquid phase and collects in the tank. After enough of the gas/liquid mixture has passed through the tank to provide a volume of gas sufficient to be readily measured, the flow is stopped and the gas volume measured. The ratio of this volume to the measured cumulative value of water exiting the gas separator provide the required data. The feed pressure of the system is about 40 psig.

Variables and results are as follows:

| Orifice diameter (inches) | Liquid velocity (feet per sec.) | Gas Feed (vol. % of gas + liquid) | Gas Distribution (% of total gas) pipe 5 | pipe 7 |
|---|---|---|---|---|
| no orifice-containing plate | 2.37 | 3.3 | 99.91 | 0.09 |
| 0.75 | 2.37 | 3.3 | 55.3 | 44.7 |
| 1 | 2.37 | 3.7 | 58.0 | 42.0 |
| no orifice-containing plate | 4.74 | 3.3 | 97.9 | 2.1 |
| 0.75 | 4.74 | 3.3 | 53.6 | 46.4 |
| 1 | 4.74 | 3.7 | 51.2 | 48.8 |
| no orifice-containing plate | 7.11 | 3.3 | 86.8 | 13.2 |
| 0.75 | 7.11 | 3.3 | 52.8 | 47.2 |

EXAMPLE 2

Example 1 is repeated. Variables and results are as follows:

| Orifice diameter (inches) | Liquid velocity (feet per sec.) | Gas Feed (vol. % of gas + liquid) | Gas Distribution (% of total gas) pipe 5 | pipe 7 |
|---|---|---|---|---|
| no orifice-containing plate | 2.37 | 5.0 | 99.89 | 0.11 |
| 0.75 | 2.37 | 5.0 | 58.4 | 46.2 |
| 1 | 2.37 | 7.5 | 56.1 | 43.9 |
| 1 | 2.37 | 15.0 | 55.8 | 46.5 |
| no orifice-containing plate | 4.74 | 5.0 | 98.3 | 1.7 |
| 0.75 | 4.74 | 5.0 | 54.8 | 45.2 |
| 1 | 4.74 | 7.5 | 50.1 | 49.9 |
| no orifice-containing plate | 7.11 | 5.0 | 95.5 | 4.5 |
| 0.75 | 7.11 | 5.0 | 53.5 | 46.5 |
| 1 | 7.11 | 5.0 | 53.5 | 46.5 |

EXAMPLE 3

Example 1 is repeated except that the pipe arrangement is in the form of a cross in the vertical plane with four pipes emanating from junction 4. Thus, referring to the drawing, feed pipe 2 and pipe 7 are in the vertical plane, pipe 5 is in the horizontal plane, and an extension of pipe 5 (not shown) is in the horizontal plane. The orifice plate when in place is located in the feed pipe six inches below the center point of junction 4. The orifice diameter is one inch and the gas feed is 3 volume percent of the gas plus liquid.

The variables and results are as follows:

| Pipe | Liquid Flow Rate (gallons/minute) | Gas Distribution (percent of total) W/O orifice | W/orifice* |
|---|---|---|---|
| 5 | 15 | 40 | 34 |
| 5, extension | 15 | 33 | 33 |
| 7 | 15 | 27 | 33 |

EXAMPLE 4

Example 3 is repeated except that all pipes are in the horizontal plane. The variables and results are as follows:

| Pipe | Liquid Flow Rate (gallons/minute) | Gas Distribution (percent of total) W/O orifice | W/orifice* |
|---|---|---|---|
| 5 | 15 | 55 | 33 |
| 5, extension | 15 | 36 | 35 |
| 7 | 15 | 9 | 32 |

*W/ means with; W/O means without

EXAMPLE 5

Example 3 is repeated except that the subject process is carried out in a three injection well in-situ uranium leaching system. In this case, all pipes are in the vertical plane and pipe 2 is the feed pipe. Pipes 5, 7, and the pipe 5 extension lead to and into the wells, one pipe to a well. While the objective of the previous examples was to achieve uniform distribution, the objective of this example is to show that the downcomer pipe carrying the gas/liquid mixture down to the bottom of the well from the well head functions as a suitable dissolution device, i.e., a device which is responsible for dissolving relatively high amounts of oxygen in a barren leach liquor (or lixivant). As noted in the following table, this pipe is sized to insure a liquid flow velocity down the well of at least one foot per second.

In this particular instance, the ore zone is 400 feet below the surface. Hydrostatic pressure is only 56 psig due to a ground water level of 130 feet above the ore zone. Oxygen solubility at the pressure and temperature of the ore zone is about 205 parts per million (ppm) by weight in the leach solution. A minimum concentration of 200 ppm is determined to be required for economical levels of uranium recovery.

Following the removal of the uranium from the pregnant liquor pumped out of the ore zone, the barren leach liquor is adjusted with regards to the chemical composition, filtered, and pumped from the process plant along line 2 to the three wells. The chemical composition of the barren leach liquor is typically a dilute alkali metal or ammonium carbonate solution with its pH controlled in the range of 6 to 9. Oxygen gas is fed into line 2 at a point close to the process plant at a rate proportional to the flow rate of the barren leach liquor such that about ten percent excess over the target concentration is fed into line 2. This allows for the small amount of oxygen which is expected to remain undissolved.

An orifice-containing plate is inserted in line 2 six inches from the center point of junction 4.

The objective is to achieve at least about 95 percent dissolution.

Measurement of the amount of oxygen undissolved in each of the test wells is made by collecting the oxygen rising within the well casing to the top of the well.

Pipe 5 serves well 1, pipe 7—well 2, and the extension of pipe 5—well 13. Variables and results are as follows:

| | Well No. 1 | 2 | 3 |
|---|---|---|---|
| At 220 ppm oxygen feed concentration: | | | |
| Liquid velocity down well (feet per second) | 2.1 | 2.0 | 1.3 |
| Well-head pressure (psig) | 20 to 25 | less than 0 | 15 to 44 |
| Oxygen vent rate (percent of total oxygen in feed, average) | 0.19 | 4.8 | 0.30 |

-continued

| | Well No. | | |
|---|---|---|---|
| | 1 | 2 | 3 |
| At 275 ppm oxygen feed concentration: | | | |
| Liquid velocity down well (feet per second) | 2.1 | 2.0 | 1.3 |
| Well-head pressure (psig) | 30 to 40 | less than 0 | 48 to 62 |
| Oxygen vent rate (percent of total oxygen in feed, average) | 0.16 | 4.9 | 0.06 |

It is found that over 95 percent of the oxygen enters the ore zone. The lower dissolution rate in well no. 2 is a result of its operating at a well-head pressure below atmospheric. This is due to the relatively high permeability of the ore zone area in which the particular well is located. Because of the low pressure, the oxygen saturation concentration as well as the driving force for gas dissolution is lower than in the other two wells.

I claim:

1. In a process for the uniform distribution of a two phase gas/liquid or liquid/liquid mixture comprising delivering a first stream of said mixture to a point, and dividing the first stream at the point into at least two streams, the improvement comprising creating a turbulent environment in the first stream just prior to the point at which the first stream is divided into at least two streams.

2. The process defined in claim 1 wherein the turbulent environment is created by increasing the velocity of the mixture to a velocity in excess of about 10 feet per second.

3. The process defined in claim 1 wherein the turbulent environment is created by a device inserted in the first stream at a distance from the dividing point of no less than about the width of the first stream.

4. The process defined in claim 1 wherein one phase of the mixture is in bubble or droplet form and in the area of turbulent environment the bubbles or droplets are subdivided into smaller bubbles or droplets and the smaller bubbles or droplets essentially do not coalesce until they have entered the streams which are the result of the division of the first stream.

5. In a process for the in-situ mining of a metal from an underground ore body containing an insoluble metal compound by introducing a two phase mixture of an oxygen containing gas and a barren lixiviant via a distribution network of conduits down into individual injection wells connected to the ore body, said network comprising a series of conduits, each of which divides at one point into at least two conduits; oxidizing the insoluble metal compound to provide a metal compound soluble in the lixiviant; dissolving the soluble metal compound in the lixiviant to provide a pregnant lixiviant; removing the pregnant lixiviant via production wells through the network to a point where the metal is separated from the lixiviant; and reintroducing the barren lixiviant into the network, the improvement comprising (a) creating a turbulent environment in each conduit just prior to the point at which the conduit is divided into at least two conduits; and (b) transporting the gas/lixiviant mixture down the injection well via a downcomer pipe at a liquid flow velocity of at least about one foot per second.

* * * * *